US006367524B1

(12) United States Patent
Brewer

(10) Patent No.: US 6,367,524 B1
(45) Date of Patent: Apr. 9, 2002

(54) ADJUSTABLE BIT FOR FORMING A WORKPIECE

(75) Inventor: James Mitchell Brewer, Mocksville, NC (US)

(73) Assignee: Freud TMM, Inc., High Point, NC (US)

( * ) Notice: Subject to any disclaimer, the term of this patent is extended or adjusted under 35 U.S.C. 154(b) by 0 days.

(21) Appl. No.: 09/756,571

(22) Filed: Jan. 8, 2001

(51) Int. Cl.[7] ..... B27M 1/00; B27C 1/00; B27C 5/00

(52) U.S. Cl. ..... 144/371; 144/91; 144/91.2; 144/135.2; 144/218; 144/231; 409/234

(58) Field of Search ..... 144/90.1, 91, 91.2, 144/1.1, 3.1, 134.1, 135.2, 137, 231, 233, 234, 235, 236, 237, 218, 367, 371; 409/203, 204, 205, 213, 232, 234

(56) References Cited

U.S. PATENT DOCUMENTS 283,678 A * 8/1883 Steele ..... 144/231
607,394 A * 7/1898 Hatch ..... 144/231
984,407 A * 2/1911 Wolvin ..... 144/91.2
1,370,895 A * 3/1921 Loomis ..... 144/135.2
1,748,767 A * 2/1930 Heston et al. ..... 144/135.2
3,008,501 A * 11/1961 Hammer ..... 144/135.2
5,316,061 A * 5/1994 Lee ..... 144/218
5,433,563 A * 7/1995 Velepec ..... 409/234
5,899,252 A * 5/1999 Pozzo ..... 144/135.2
5,996,659 A * 12/1999 Burgess ..... 144/218

OTHER PUBLICATIONS

Amana Tool 2001/2002 Catalog (2 pages).
CMT Cutting Tools, The Millennium Edition (2 pages).
Freud General Products Catalog (2 pages).
Eagle America—Special Millenium Edition Catalog (2 pages).
Woodworker's Supply, Inc. Catalog (2 pages).
Bosch Catalog (2 pages).

* cited by examiner

*Primary Examiner*—W Donald Bray
(74) *Attorney, Agent, or Firm*—Kennedy Covington Lobdell & Hickman, LLP

(57) ABSTRACT

An adjustable bit for cutting tongues or grooves in a wooden workpiece that includes first and second cutter members adjustably mounted on a drive shaft, a plurality of spacer elements selectively mountable on the drive shaft to vary the axial spacing between the cutter members. At least some of the spacer elements preferably having varying thicknesses, and a ball bearing pilot member may be one of the spacer members. The cutter members may be formed for cutting a groove in the workpiece, or formed to cut a tongue in the workpiece.

3 Claims, 9 Drawing Sheets

ADJUSTABLE BIT FOR FORMING A WORKPIECE

BACKGROUND OF THE INVENTION

The present invention related generally to router bits for forming a workpiece, and more particularly to bits of this type that are designed to form tongues and grooves in the workpiece.

As is well known in the art, when it is desired to cut a groove or a corresponding tongue into the side face of a wooden workpiece, a rotating bit is provided which includes two cutter elements fixed onto a drive shaft, and the rotating bit is moved laterally into contact with the edge of the workpiece to be formed. If the workpiece is to be formed with a tongue, the bit includes two cutter members fixed thereon at a spacing corresponding to the thickness of the tongue to be formed so that the edge of the workpiece is cut away by the cutter elements above and below the portion that becomes the tongue. Similarly, if the workpiece to be formed is a groove, the bit includes a single cutter member having a thickness corresponding to the desired thickness of the groove.

In either event, each of the cutter elements is fixed to the drive shaft, and therefore each bit can only cut a tongue or groove having one specific thickness. Therefore, in applications where it is necessary to form workpieces with grooves and tongues having varying thicknesses, it is necessary to have in stock a large inventory of bits, each being capable of cutting one groove or tongue thickness within the range of desired thicknesses. Obviously, this can significantly increase the expense of the workshop in acquiring and maintaining the required number of bits that may be necessary for the particular operations of the workshop.

It is also known to provide a drive shaft onto which any one of a number of different sized cutter members can be secured in fixed relation to one another to thereby vary the thickness of the tongue or groove to be formed by the bit. In this arrangement, each of the cutter members has a fixed axial thickness, and when the thickness of the tongue or groove to be formed is determined, the operator selects the two particular cutter members that will provide the desired thickness, and then mounts these two cutter members on the drive shaft.

This arrangement is an improvement over the above-described practice of maintaining a large number of different bits in stock, but it also has a similar disadvantage in that it requires the workshop to maintain in inventory a large number of cutter elements of varying sizes that can be mounted on the drive shaft to form a tongue or groove of a desired thickness.

Additionally, this arrangement has a further disadvantage in that the size of the replaceable cutter members makes it difficult for any two of them to be mounted on the drive shaft with the required axial tolerance needed to form a tongue or groove of a specific axial thickness.

SUMMARY OF THE INVENTION

The present invention provides an adjustable bit for cutting tongues or grooves in a wooden workpiece which includes an axially extending drive shaft, a first cutter member mounted on the drive shaft and movable along the axial length thereof, and a second cutter member mounted on the shaft and movable along the axial length thereof A plurality of spacer elements are selectively mountable on the shaft intermediate the first and second cutter members to vary the axial spacing therebetween. A cap member is removably mounted on the drive shaft to permit at least one of the cutter members to be mounted on and removed from the shaft, and to permit one or more of the spacer elements to be mounted on and removed from the shaft, and the cap member has a fixed position thereon for holding in place the first and second cutter members and the spacer elements therebetween, whereby the adjustable bit can be used to cut grooves or tongues of varying thicknesses in the workpiece.

In one of the preferred embodiments, at least some of the spacer elements have different axial thicknesses, and there may be nine of the spacer elements mountable on the drive shaft, with some of the spacer elements having the same axial thickness and some of the spacer elements have axial thicknesses which are different from other spacer elements. More particularly, it is preferred that four of the spacer elements have an axial thickness of 1 mm; two of the spacer elements have an axial thickness of 0.2 mm; and three of the spacer elements have an axial thickness of 0.5 mm, 0.15 mm and 0.1 mm, respectively.

It is also preferable that the cutter members, the spacer elements and the cap member be stacked on the drive shaft with the first cutter members being in the lowermost position, with at least some of the spacer elements on top of the first cutter member, with the second cutter members being on top of the spacer elements, and with the cap member fixed in place on the shaft above the second cutter member. However, the spacer elements may be arranged so that some of them are located between the first and second cutter members to provide the desired spacing therebetween, and any remaining spacer elements can be conveniently carried above the second cutter member and between the second cutter member and the cap member.

In one embodiment of the present invention, the first and second cutter members are formed to cut a tongue in the workpiece. In this embodiment, the spacer elements preferably include a ball bearing pilot member disposed between the first and second cutter members to provide a guide surface for the workpiece as it is being cut by the adjustable bit, and the spacer elements also include a plurality of shims, at least some of which are mounted on the drive shaft between the ball bearing pilot member and at least one of the first and second cutter members.

In another embodiment of the present invention, the first and second members are formed to cut a groove in the workpiece, and in this embodiment the first and second cutter members are provided with cutting blades that are capable of overlapping one another in the axial direction whereby grooves of different depths can be cut using the same cutter members and the aforesaid spacer elements.

DESCRIPTION OF THE PREFERRED EMBODIMENTS

Figure 1:
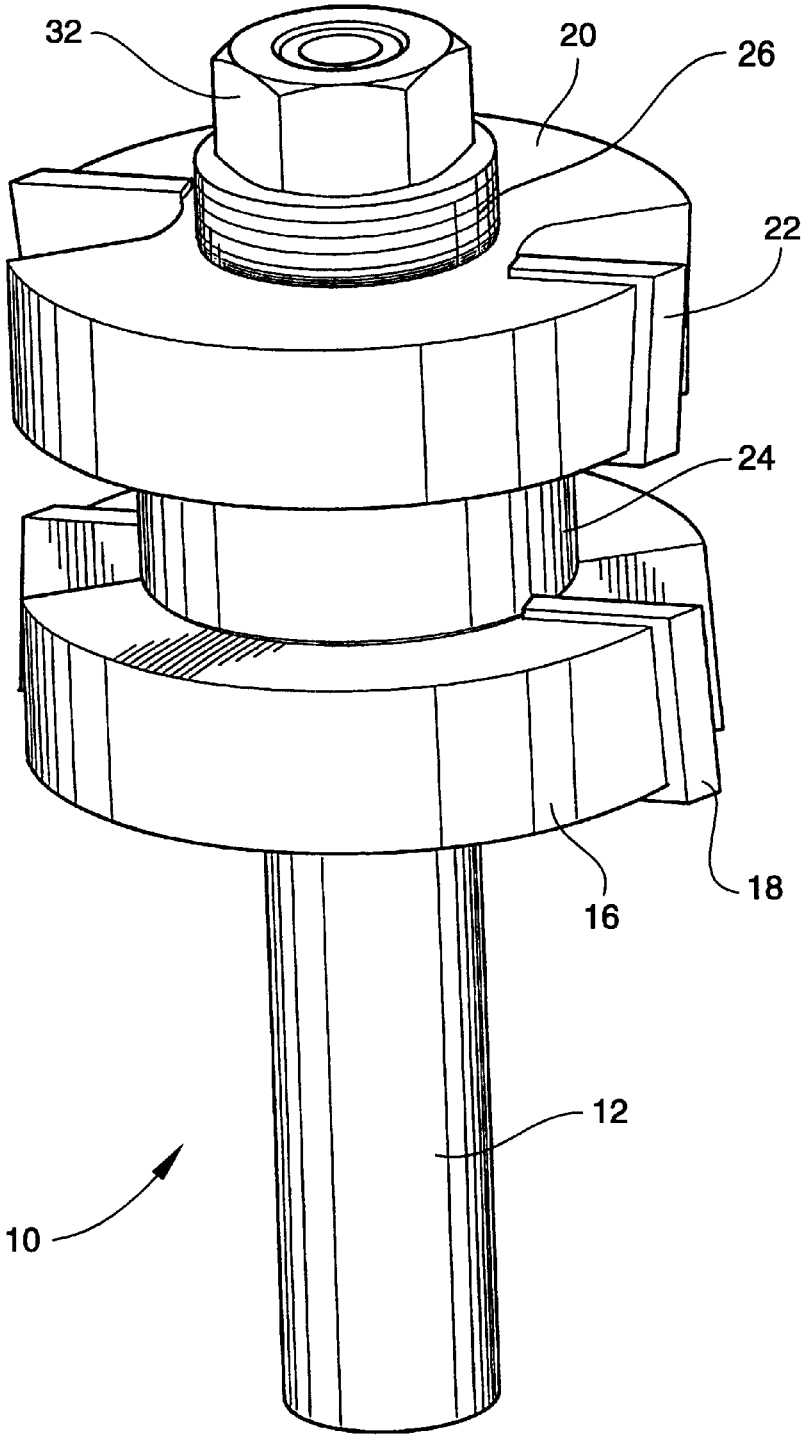
FIG. 1 is a perspective view of one embodiment of the present invention illustrating a bit which is designed to form a tongue in a workpiece.
Figure 2:
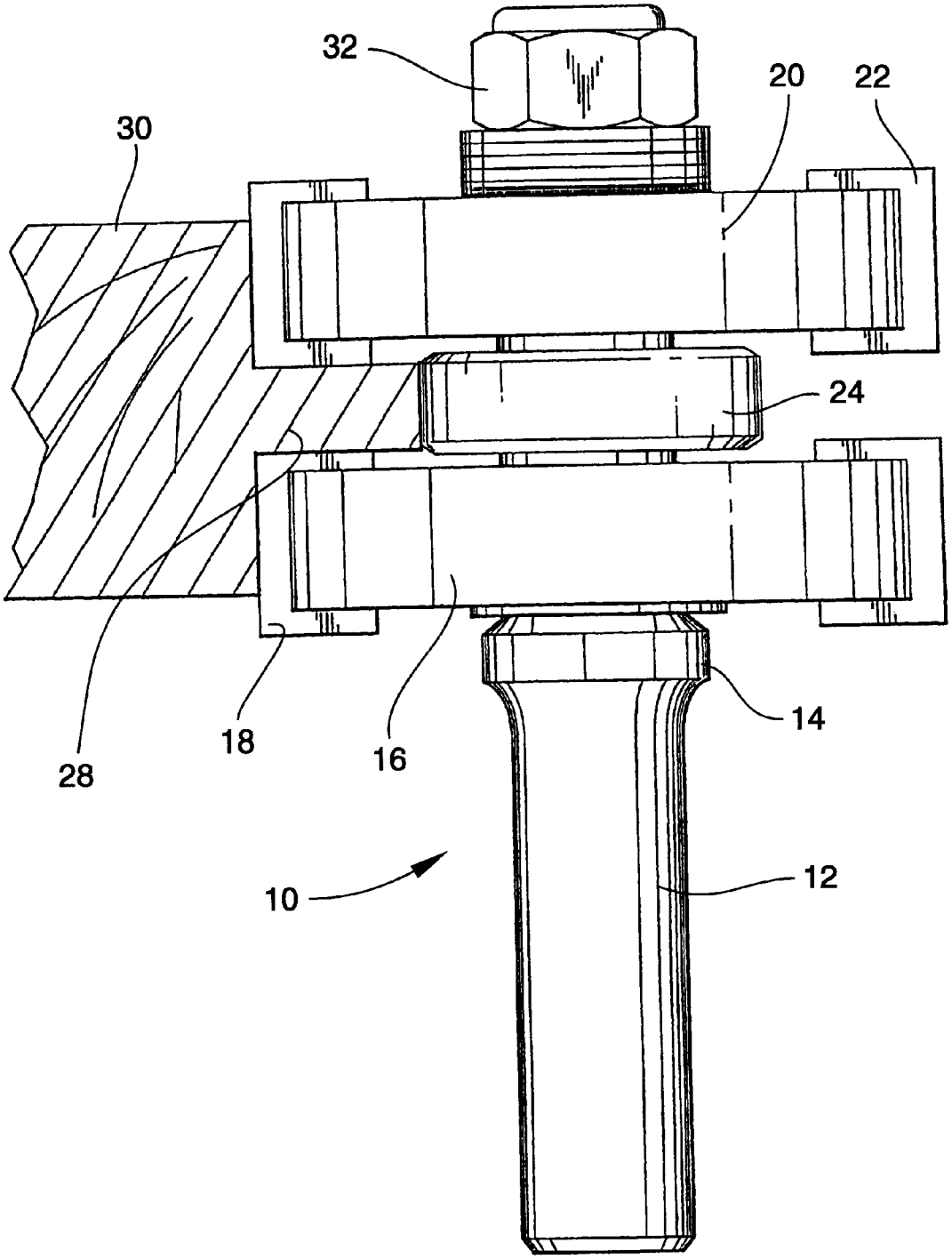
FIG. 2 is a side elevational view of the bit illustrated in FIG. 1 cutting a tongue in a workpiece.

Looking now in greater detail at the accompanying drawings, FIGS. 1 and 2 illustrate an adjustable bit 10 according to one embodiment of the present invention. The bit 10 includes a general cylindrical drive shaft 12 formed with a shoulder 14. The upper end of the drive shaft 12 extends upwardly through a first cutter member 16 that has a cutting blade 18 fixed at its outer periphery in a conventional manner. The drive shaft 12 also extends through a second cutter member 20 having a peripheral cutting blade 22, and, intermediate the first and second cutter members 16 and 20, a spacer member in the form of a ball bearing pilot member 24 is mounted for rotation relative to the drive shaft 10. A plurality of spacer elements in the form of shims 26 are disposed above the second cutter member 20, and a cap member 28, which is preferably a threaded nut, is threaded onto the top end of the drive shaft 10 and fixed in place thereon to securely hold in place the first and second cutter member 16, 20, the ball bearing pilot member 24, and the shims 26.

Figure 2A:
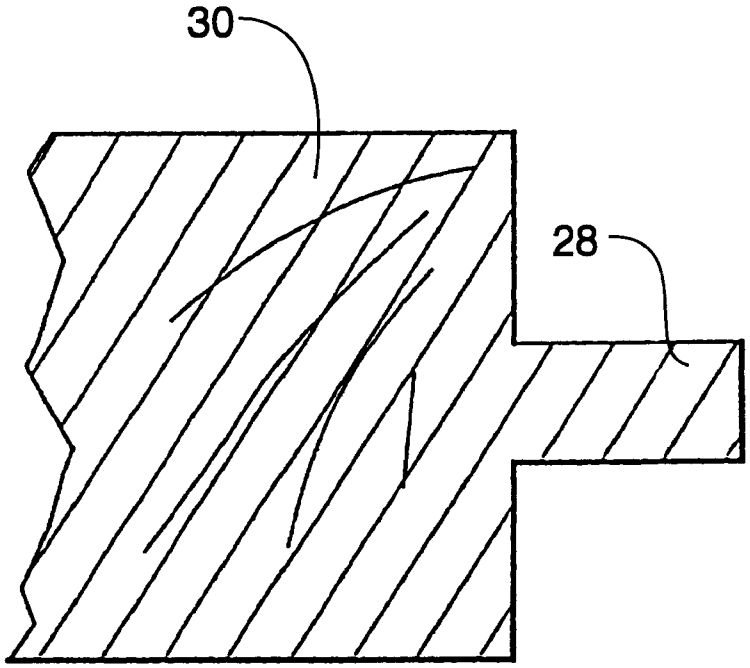
FIG. 2A is a detail view showing a tongue formed by the bit illustrated in FIG. 1.

As best seen in 62, the ball bearing pilot member 24 acts as a spacer element to separate the first and second cutter members 16, 20 by an axial dimension corresponding to the axial thickness of the ball bearing pilot member 24. Accordingly, with the several elements held in place as described above, it will be seen in FIG. 2 that the bit 10 can be used to cut a tongue 28 in a wooden work piece 30, and the tongue 28 has a particular, desired thickness or depth, depending on the axial thickness of the ball bearing pilot member 24 and the size and location of the blades 18, 22 on the first and second cutter member 16, 20. It will also be noted that the extending end face of the tongue 28 abuts the other periphery of the ball bearing pilot member 24 so that the ball bearing pilot member 24 establishes a consistent extending dimension for the tongue 28 after it is cut, and since the pilot member 24 is rotatably mounted on the drive shaft 12, there is little or no frictional resistance between the end face of the tongue 28 and the exterior surface of the pilot member 24. Thus, utilizing the bit 10 as illustrated in FIGS. 1 and 2, the work piece thirty is formed with a tongue 28 as illustrated in FIG. 2A that has a precise thickness, and a precise extending length.

In accordance with the present invention, the same components as those described above can be readily rearranged to vary the thickness of the tongue 28 cut by the bit 10. More specifically, if the nut 32 is removed from the threaded upper end of the drive shaft 12, the shims 26, the second cutter member 20, and the ball bearing pilot member 24 can be easily removed from the drive shaft 12 by sliding them upwardly. Depending on the desire depth of the new tongue 28 to be cut, all of these components can then be rearranged in a variety of different configuration to provide the desired depth for the tongue 28.

Figure 3:
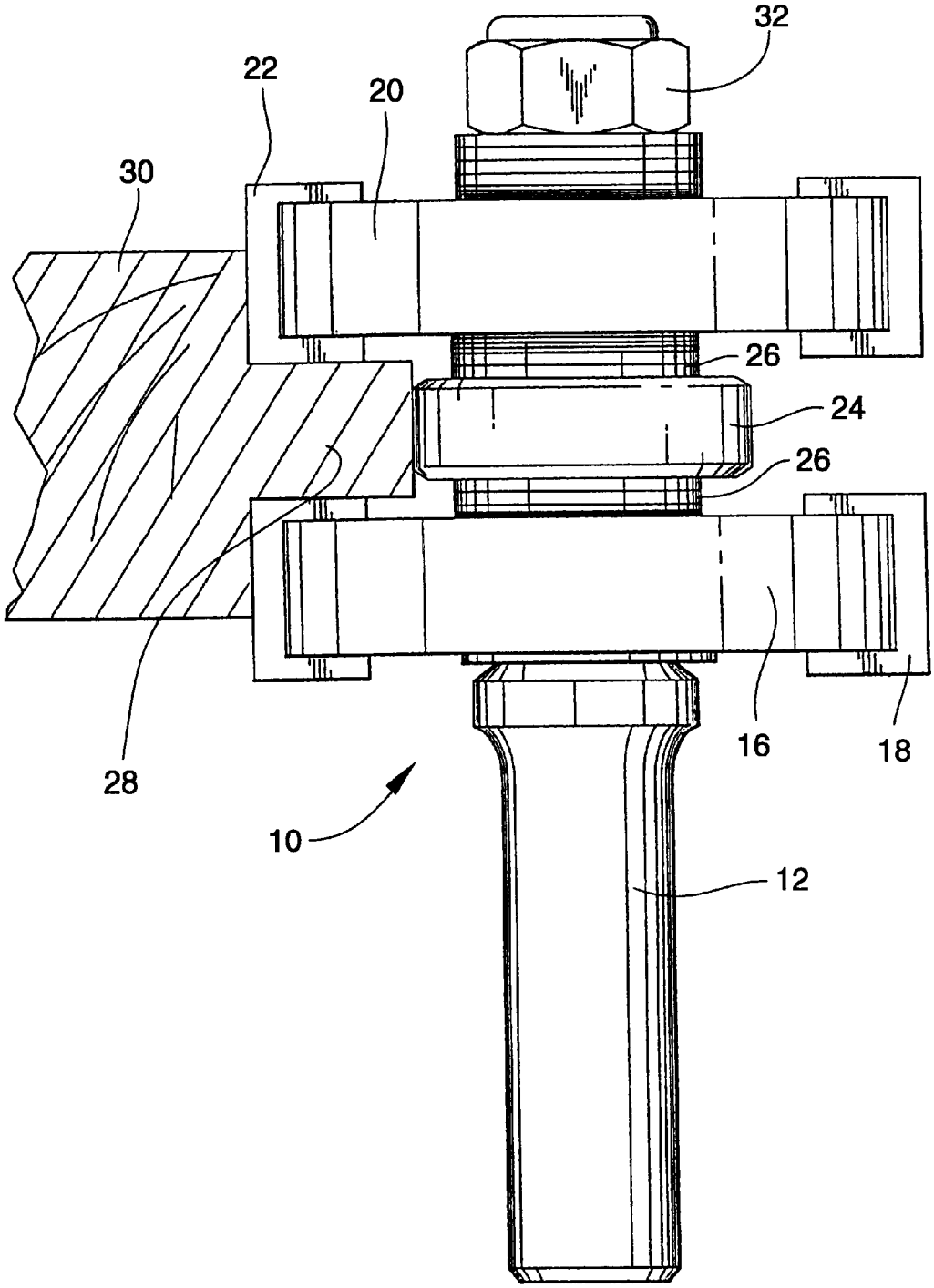
FIG. 3 is a side elevational view of the bit illustrated in FIG. 1, with the cutter members in an adjusted position.

An example of one such configuration is illustrated in FIG. 3. The first cutter member 16 is positioned on the shoulder 14 of the drive shaft 12, and a desired number of shims 26 are slid onto the drive shaft 12, then the ball bearing pilot member 14 is placed on top of the first group of shims 26, and then a second group of shims 26 is placed on top of the ball bearing pilot member 24. The second cutter member 20 is then slidably mounted on the drive shaft 12 with any remaining shims 26 disposed on top of the second cutter member 20, and the cap member 32 is threaded onto the drive shaft 12 to hold all of the components securely in place.

Figure 3A:
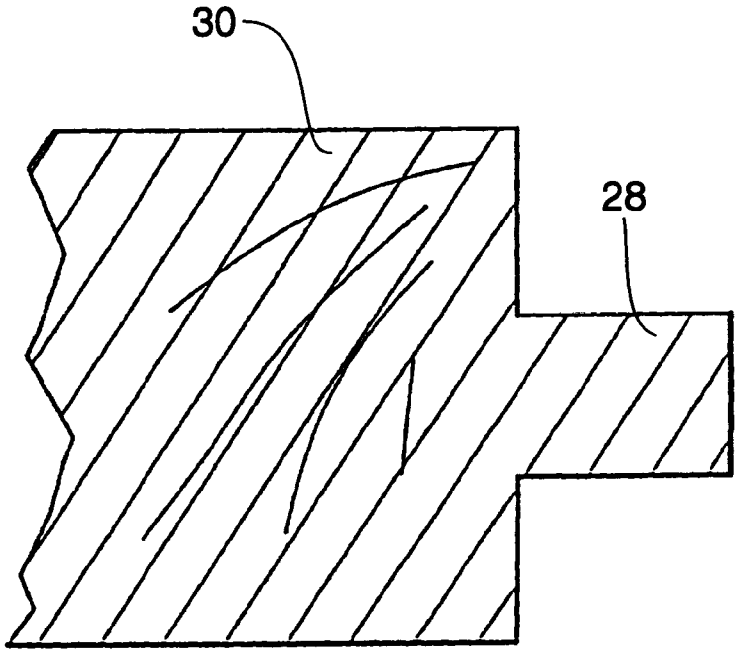
FIG. 3A is a detail view showing a tongue formed by the bit illustrated in FIG. 3.

Accordingly, in comparing the configurations of components as illustrated in FIGS. 2 and 3, it will be seen that the depth or thickness of the tongue 28 is increased in FIG. 3 by a dimension corresponding to the collective axial thickness of the shims 26 that are positioned above and below the ball bearing pilot member 24. The tongue cut by the configuration by the bit illustrated in FIG. 3 is shown in FIG. 3A.

Thus, in accordance with the present invention, exactly the same components that are used to form the bit 10 as illustrated in FIG. 2 can also be used to create a bit 10 for cutting a tongue having a different depth or thickness. Also, it will be apparent that the number of variations in the thickness of the tongue 28 can be readily controlled by the number and axial thicknesses of the spacer elements in the form of the ball bearing pilot member 24 and the shims 26. Moreover, as illustrated in FIGS. 2 and 3, any shims 26 that are not being used as spacer elements for the first and second cutter members 16, 20 are conveniently stored between the upper surface of the second cutter member 20 and the nut 32.

Figure 7:
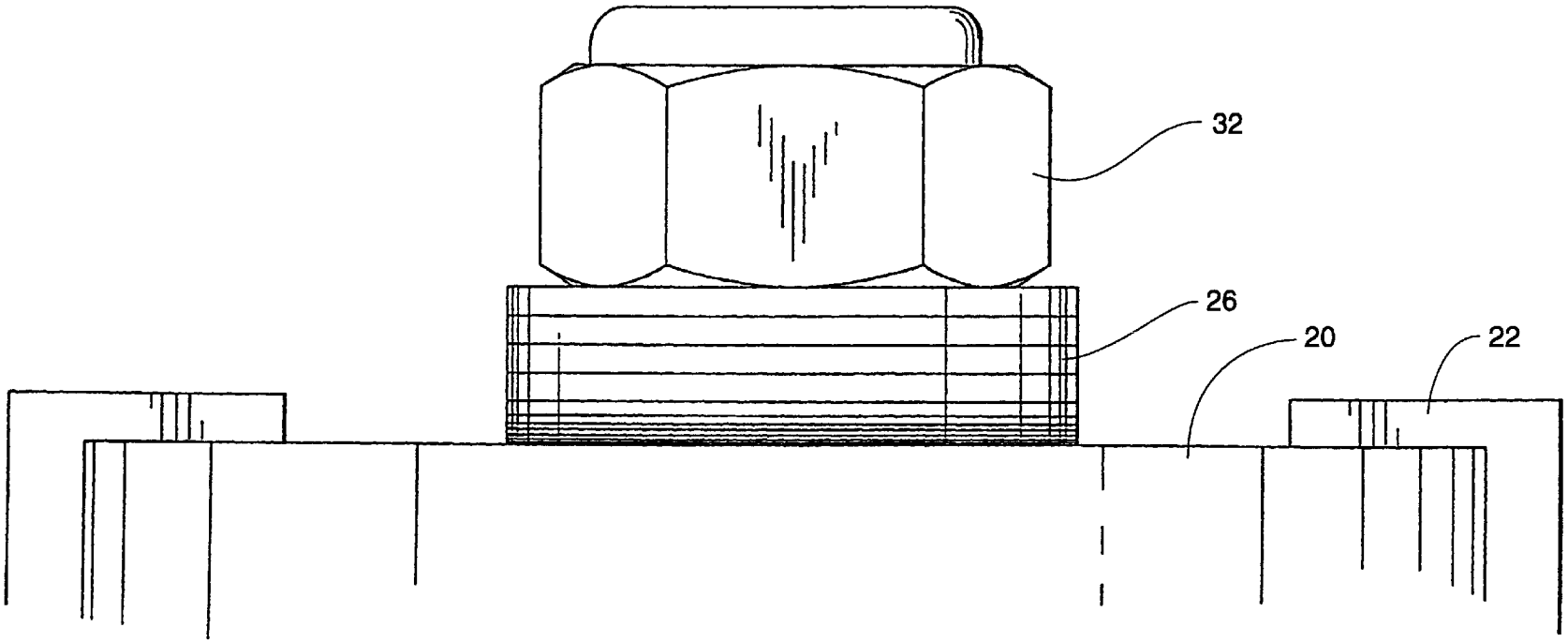
FIG. 7 is a detail view showing a plurality of spacer shims mounted on the drive shaft.

It will be understood that the number of shims 26 provided with a particular bit 10, and the axial thicknesses of the shims 26, can be varied over a wide range, depending on the particular application of the bit 10. However, when the adjustable bit 10 is used in applications common to most woodworking shops, it has been found that a group of nine shims 26 provide a particularly desirable range of tongue-cutting variations. Preferably, four of the shims 26 have an axial thickness of 1 mm, two of the shims have an axial thickness of 0.2 mm, and the remaining three shims 26 have axial thicknesses of 0.5 mm, 0.15 mm, and 0.1 mm, respectively. This representative collection of shims 26 is illustrated in FIG. 7 with all of the shims 26 in their stored position between the upper surface and the second cutter member 20 and the nut 32.

Figure 5A:
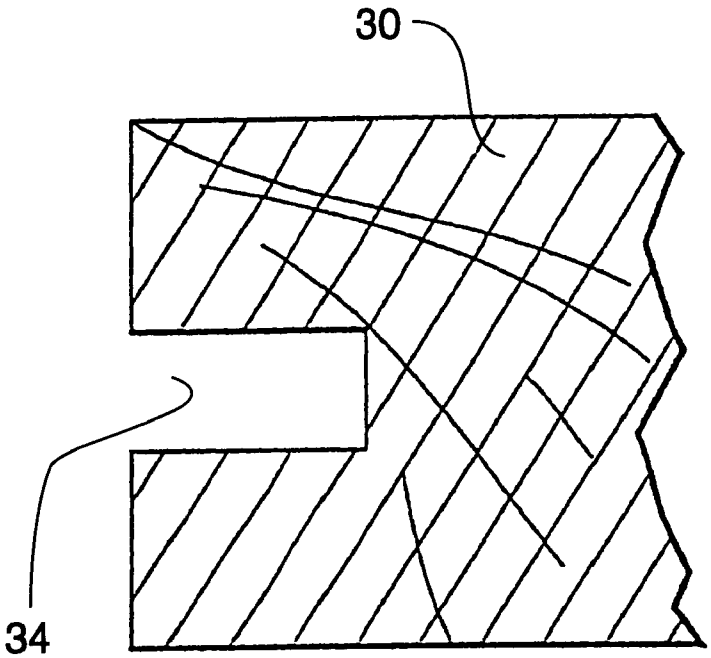
FIG. 5A is a detail view showing a groove formed by the bit illustrated in FIG. 4.
Figure 6A:
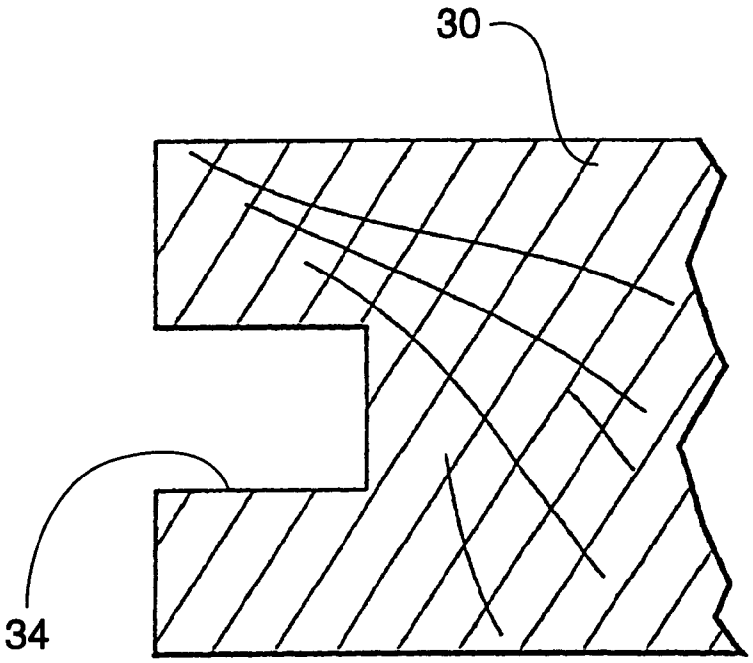
FIG. 6A is a detail view showing a groove formed by the bit illustrated in FIG. 6.
Figure 4:
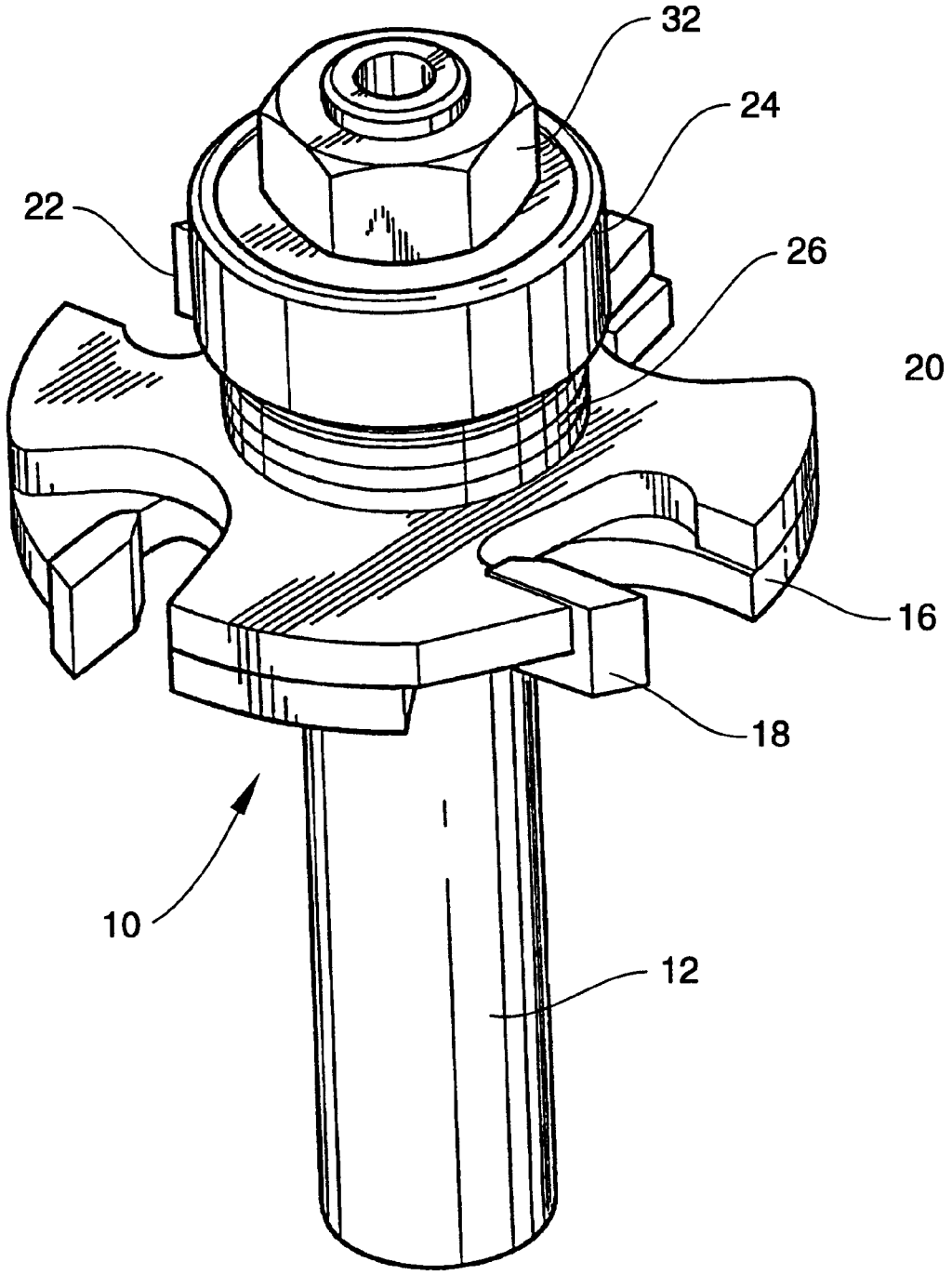
FIG. 4 is a perspective view of another embodiment of the present invention illustrating a bit which is designed to form a groove in a workpiece.
Figure 5:
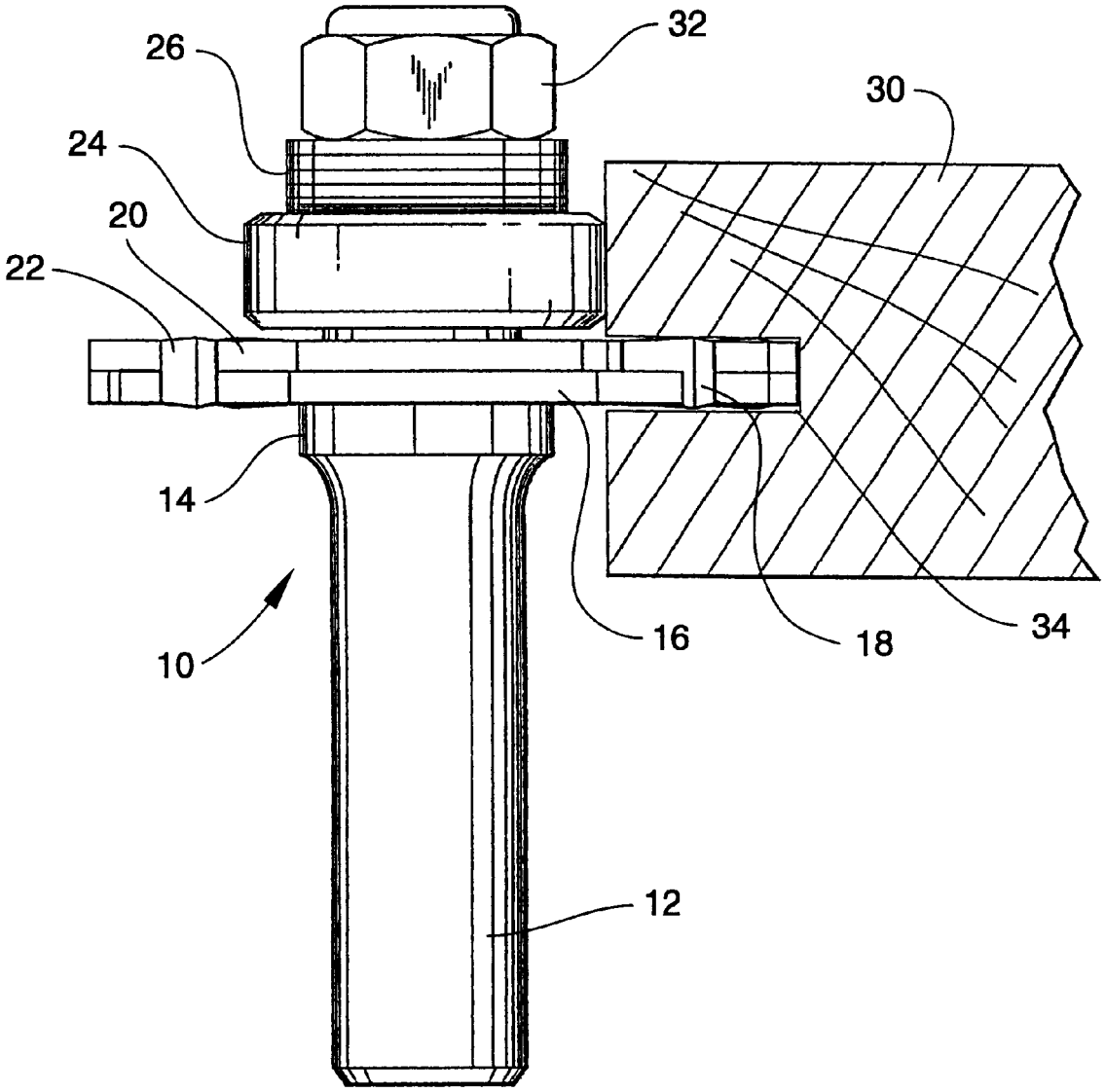
FIG. 5 is a side elevational view of the bit illustrated in FIG. 4 cutting a groove in a workpiece.
Figure 6:
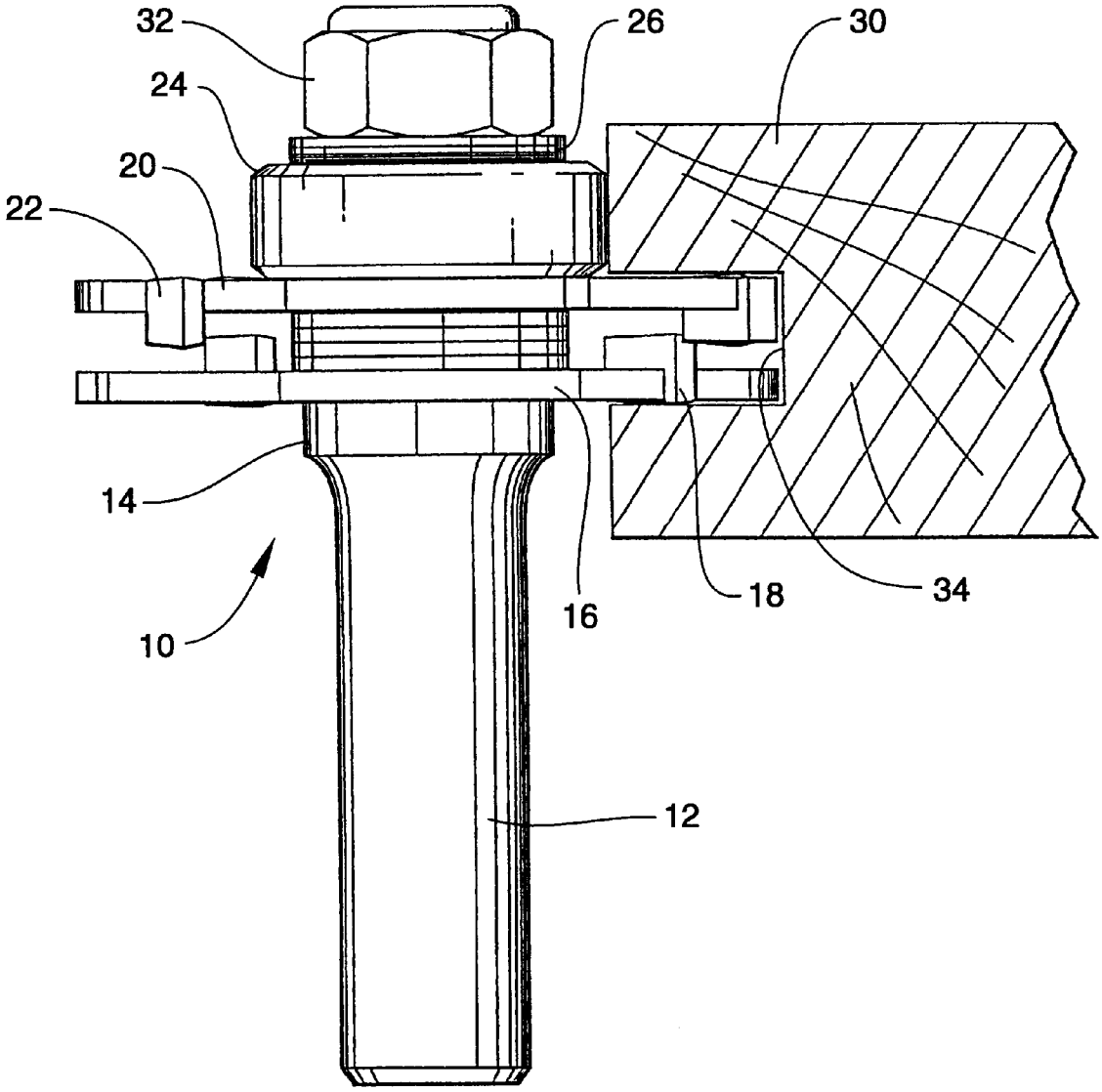
FIG. 6 is a side elevational view of the bit illustrated in FIG. 4, with the cutter members in an adjusted position.

The adjustable bit 10 of the present invention may also be used to cut grooves 34 in the work piece 28 using a configuration of elements as best illustrated in FIGS. 4, 5 and 6.

More specifically, looking first at FIGS. 4 and 5, the first and second cutters 16, 20 have cutter blades 18, 22 mounted at the periphery thereof as described above. However, in this arrangement, when the first and second cutter member 16, 20 are disposed in direct contact with one another as best seen in FIG. 5, the cutting blades 18, 22 overlap one another in the axial direction, and they are radilly offset from one another as well. Accordingly, in this configuration, the adjustable bit 10 can be used to cut a groove 34 in the work piece 28 which has a thickness or depth that is less than the combined axial thicknesses of the cutting blades 18, 22. The groove 34 cut with this configuration is illustrated in FIG. 5A, and it will also be noted that in this configuration the ball bearing pilot member 24 and all of the shims 26 are slidably mounted on the drive shaft 12 above the second cutter member 20, and they are held in place by the nut 32.

When it is desired to change the depth of the groove 34 to be cut by the adjustable bit 10, the nut 32 is removed along with the ball bearing pilot member 24 and the shims 26, and these components are then placed on the drive shaft 12 with a new arrangement in which a desired number of the shims 26 are disposed between the first and second cutter member 16, 20 as best illustrated in FIG. 6. It will be noted, also, that even though the first and second cutter members 16, 20 are now spaced from one another by the collective axial thicknesses of the shims 26 located therebetween, the cutter blades 18, 22 are still partially overlapped or immediately adjacent one another in the axial direction so that the enlarged groove 34 can be readily cut by the adjustable bit 10. The enlarged groove 34 cut by the adjustable bit illustrated in FIG. 6 is shown in FIG. 6A.

Accordingly, the present invention provides an adjustable bit 10 that can be used for cutting a tongue 28 or a groove 34 in a work piece 30, and requires only a simple tool for removing the nut 32 to permit the adjustable bit 10 to be adjusted to a wide variety of cutting depths, all without requiring any inventory of different sized cutting members. Moreover, all of the necessary components for varying the cut are readily carried on the drive shaft 12, either in a position to act as a spacer element or conveniently stored at the top of the adjustable bit 10.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the invention has been described herein in detail in relation to its preferred embodiment, it is to be understood that this disclosure is only illustrative and exemplary or the present invention and is made merely for purposes of provided a full and enabling disclosure of the invention. The foregoing discussion is not intended or to be construed to limit the present invention of otherwise to exclude any such other embodiments, adaptations, variations, modifications and equivalent arrangements.

What is claimed is:

1. An adjustable bit for cutting tongues or grooves in a wooden workpiece which includes:

(a) an axially extending drive shaft;

(b) a first cutter member mounted on said drive shaft and movable along the axial length thereof;

(c) a second cutter member mounted on said shaft and movable along the axial length thereof;

(d) a plurality of spacer elements selectively mountable on said shaft intermediate said first and second cutter members to vary the axial spacing therebetween, wherein said plurality of spacer elements includes a ball bearing pilot member disposed between said first and second cutter members to provide a guide surface for said workpiece as it is being cut by said adjustable bit; and (e) a cap member removably mounted on said drive shaft to permit at least one of said cutter members to be mounted on and removed from said shaft, and to permit one or more of said spacer elements to be mounted on and removed from said shaft, said cap member having a plurality of fixed positions hereon for holding in place said first and second cutter members and said spacer elements therebetween, whereby said adjustable bit can be used to cut grooves or tongues of varying thicknesses in said workpiece.

2. An adjustable bit for cutting tongues or grooves in a wooden workpiece which includes:

(a) an axially extending drive shaft;

(b) a first cutter member formed for cutting a tongue in said workpiece mounted on said drive shaft and movable along the axial length thereof, (c) a second cutter member formed for cutting a tongue in said workpiece mounted on said shaft and movable along the axial length thereof, (d) a plurality of spacer elements selectively mountable on said shaft intermediate said first and second cutter members to vary the axial spacing therebetween, said plurality of spacers including a ball bearing pilot member disposed between said first and second cutter members to provide a guide surface for said workpiece as it is being cut by said adjustable bit and a plurality of shims removably mounted on said drive shaft between said ball bearing pilot member and said first and second cutter members, with at least one of said shims having an axial thickness different from the axial thickness of some of the other shims; and (e) a cap member removably mounted on said drive shaft to permit at least one of said cutter members to be mounted on and removed from said shaft, and to permit one or more of said spacer elements to be mounted on and removed from said shaft, said cap member having a plurality of fixed position thereon for holding in place said first and second cutter members and said spacer elements therebetween, whereby said adjustable bit can be used to cut grooves or tongues of varying thicknesses in said workpiece.

3. A method of forming an adjustable bit for cutting tongues or grooves in a wooden workpiece, said method comprising the steps of:

(a) providing an axially extending drive shaft;

(b) sliding a first cutter member onto said drive shaft to a fixed position thereon;

(c) providing a plurality of spacer elements having openings therein corresponding to the diameter of said drive shaft with at least some of said spacer elements having an axial thickness different from the axial thickness of the other spacer elements, wherein said step of providing a plurality of spacer elements includes providing a ball bearing pilot having an exterior surface positioned to provide a guide surface for said workpiece as it is being cut by said adjustable bit;

(d) selecting one or more of said spacer elements that have a combined axial thickness corresponding to the groove or tongue to be cut into said workpiece;

(e) sliding the said selected spacer elements onto said drive shaft and on top of said first cutter member;

(f) sliding a second cutter member onto said drive shaft and on top of any said spacer elements; and (g) mounting a removable cap member on said drive shaft for axial movement therealong to secure said first and second cutter members and said spacer elements in place on said drive shaft to provide a bit having a selected predetermined spacing between said first and second cutter members.

* * * * *